US007762333B2

(12) United States Patent
Themig et al.

(10) Patent No.: US 7,762,333 B2
(45) Date of Patent: Jul. 27, 2010

(54) HYDRAULICALLY OPENABLE PORTED SUB

(75) Inventors: Daniel Jon Themig, Cochrane (CA); Cory Trent Saulou, Edmonton (CA)

(73) Assignee: Packers Plus Energy Services Inc., Calgary (CA)

( * ) Notice: Subject to any disclaimer, the term of this patent is extended or adjusted under 35 U.S.C. 154(b) by 52 days.

(21) Appl. No.: 12/172,882

(22) Filed: Jul. 14, 2008

(65) Prior Publication Data

US 2009/0242187 A1 Oct. 1, 2009

Related U.S. Application Data

(60) Provisional application No. 61/041,416, filed on Apr. 1, 2008.

(51) Int. Cl.
*E21B 34/14* (2006.01)

(52) U.S. Cl. ..... 166/305.1; 166/386; 166/334.4

(58) Field of Classification Search ..... 166/386, 166/305.1, 306, 320, 334.4
See application file for complete search history.

(56) References Cited

U.S. PATENT DOCUMENTS 5,069,280 A 12/1991 McKee et al.
5,297,634 A 3/1994 Loughlin
5,394,941 A * 3/1995 Venditto et al. ..... 166/255.2
6,666,270 B2 12/2003 Vann
2007/0240883 A1 10/2007 Telfer
2009/0084553 A1 * 4/2009 Rytlewski et al. ..... 166/305.1

* cited by examiner

*Primary Examiner*—William P Neuder
(74) *Attorney, Agent, or Firm*—Bennett Jones LLP

(57) ABSTRACT

A ported sub comprising: a tubular body including a wall and ends formed for installation in a wellbore tubular string; a first port through the wall; a second port through the wall; a first hydraulically openable sliding sleeve for the controlling the open and closed condition of the first port; a second hydraulically openable sliding sleeve for the controlling the open and closed condition of the second port; a first pressure release connection for securing the first hydraulically openable sliding sleeve in a position on the tubular body and being releasable by application of a selected hydraulic pressure to the first hydraulically openable sliding sleeve; and a second pressure release connection for securing the second hydraulically openable sliding sleeve in a position on the tubular body and being releasable by application of hydraulic pressure at least substantially similar to the selected hydraulic pressure to the second hydraulically openable sliding sleeve, the first pressure release connection including a first type of pressure release mechanism and the second pressure release connection including a second type of pressure release mechanism different than the first type of pressure release mechanism. A tubing string and method may employ the ported sub.

23 Claims, 2 Drawing Sheets

HYDRAULICALLY OPENABLE PORTED SUB

FIELD

The present invention relates to downhole tubulars and, in particular, a wellbore tubular device for delivering fluid to a wellbore annulus.

BACKGROUND

Wellbore fluid treatments such as fracing are sometimes effected through tubular strings including ported tubulars. In some cases, it is useful to run the ported tubular in a port closed condition and open the ports when the tubular is in position in the wellbore. For this purpose, valves may be provided for the ports to allow selective opening of the ports.

In some tubulars, a hydraulically openable sleeve valve is provided and positioned to act over one or more ports. The sleeve valve is axially slidable along the tubular from a position covering and closing the ports over which it is disposed to act to a position where it is retracted from and opens the ports. The sleeve valve includes a piston face that may be acted upon by hydraulic pressure, controlled from surface, in order to move the sleeve. The sleeve may act in the inner bore of the tubular to move along the inner wall surface or the sleeve may act along the outer surface of the tubular. Shear screws, also termed shear pins, may be used to hold the sleeve valve in the port closed position until sufficient pressures are encountered to overcome the holding capabilities of the shear screws to move the sleeve.

In ported tubulars that include hydraulically driven sliding sleeve valves for opening ports therein, there is a lot of reliance on shear pin stock. The shear pins are selected to fail at a particular shear pressure, as applied by hydraulic pressure acting on the sleeve, and if the shear pin rating is erroneously indicated, if the shear pins are defective or if more screws than called for in any design are used, the sleeve may not be released, leaving the ports of that tubular sub unopened. A similar problem may occur where the sliding sleeve becomes jammed by debris or damage.

SUMMARY

In accordance with a broad aspect of the present invention, there is provided a ported sub comprising: a tubular body including a wall and ends formed for installation in a wellbore tubular string; a first port through the wall; a second port through the wall; a first hydraulically openable sliding sleeve for the controlling the open and closed condition of the first port; a second hydraulically openable sliding sleeve for the controlling the open and closed condition of the second port; a first pressure release connection for securing the first hydraulically openable sliding sleeve in a position on the tubular body and being releasable by application of a selected hydraulic pressure to the first hydraulically openable sliding sleeve; and a second pressure release connection for securing the second hydraulically openable sliding sleeve in a position on the tubular body and being releasable by application of hydraulic pressure at least substantially similar to the selected hydraulic pressure to the second hydraulically openable sliding sleeve, the first pressure release connection including a first type of pressure release mechanism and the second pressure release connection including a second type of pressure release mechanism different than the first type of pressure release mechanism.

In accordance with another broad aspect of the invention, there is provided a wellbore fluid treatment string comprising: a tubular string including an outer surface and an inner bore; a first packer mounted on the tubular string defining a selected portion of the outer surface therebelow; a first port providing communication between the inner bore and the selected portion of the outer surface; a second port providing communication between the inner bore, the selected portion of the outer surface and the first port along the selected portion of the outer surface; a first hydraulically openable sliding sleeve for controlling the open and closed condition of the first port; a second hydraulically openable sliding sleeve for controlling the open and closed condition of the second port; a first pressure release connection for securing the first hydraulically openable sliding sleeve in a position on the tubular body and being releasable to allow the first hydraulically openable sliding sleeve to move by application of a selected hydraulic pressure to the first hydraulically openable sliding sleeve; and a second pressure release connection for securing the second hydraulically openable sliding sleeve in a position on the tubular body and being releasable to allow the second hydraulically openable sliding sleeve to move by application of a hydraulic pressure at least substantially similar to the selected hydraulic pressure to the second hydraulically openable sliding sleeve, the first pressure release connection including a first type of pressure release mechanism and the second pressure release connection including a second type of pressure release mechanism different than the first type of pressure release mechanism.

In accordance with another broad aspect, there is provided a method for gaining access to an isolated region of a wellbore, the method comprising: installing a tubular string including an outer surface and an inner bore; a first packer mounted on the tubular string defining a selected portion of the outer surface therebelow; a first port providing communication between the inner bore and the selected portion of the outer surface; a second port providing communication between the inner bore, the selected portion of the outer surface and the first port along the selected portion of the outer surface; a first hydraulically openable sliding sleeve for controlling the open and closed condition of the first port; a second hydraulically openable sliding sleeve for controlling the open and closed condition of the second port; a first pressure release connection for securing the first hydraulically openable sliding sleeve in a position on the tubular body and being releasable by application of a selected hydraulic pressure to the first hydraulically openable sliding sleeve; and a second pressure release connection for securing the second hydraulically openable sliding sleeve in a position on the tubular body and being releasable by application of a hydraulic pressure at least substantially similar to the selected hydraulic pressure to the second hydraulically openable sliding sleeve, the first pressure release connection including a first type of pressure release mechanism and the second pressure release connection including a second type of pressure release mechanism different than the first type of pressure release mechanism; setting the first packer against a wall of the wellbore to form an isolated wellbore region below the first packer; raising the tubing pressure within the tubing string to overcome at least one of the first pressure release connection and the second pressure release connection to open at least one of the first port and the second port to thereby gain access to the isolated region of the wellbore.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
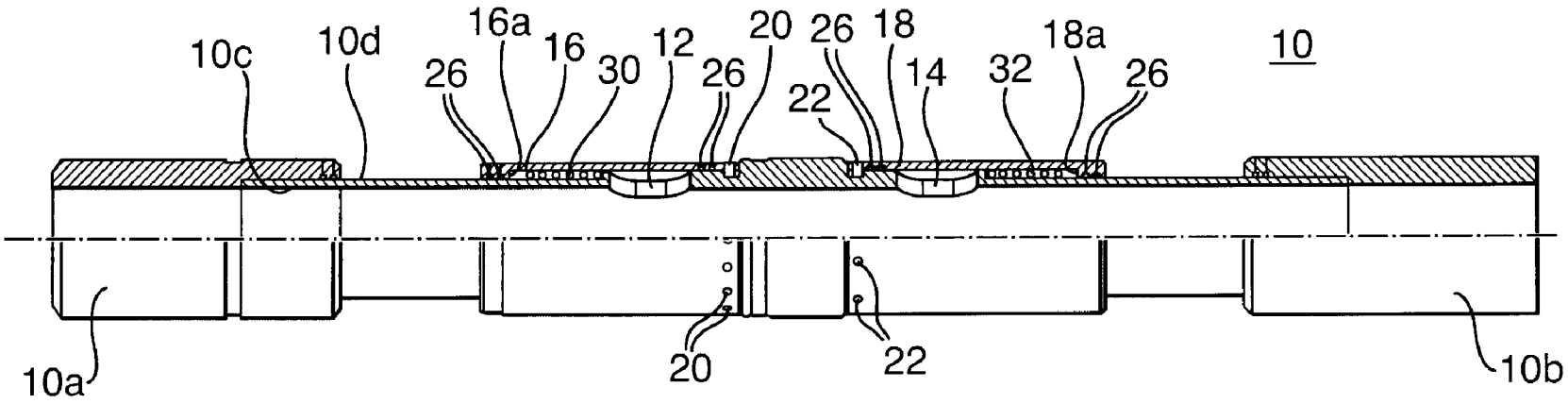
FIG. 1 is a quarter sectional view along a tubular sub.
Figure 2:
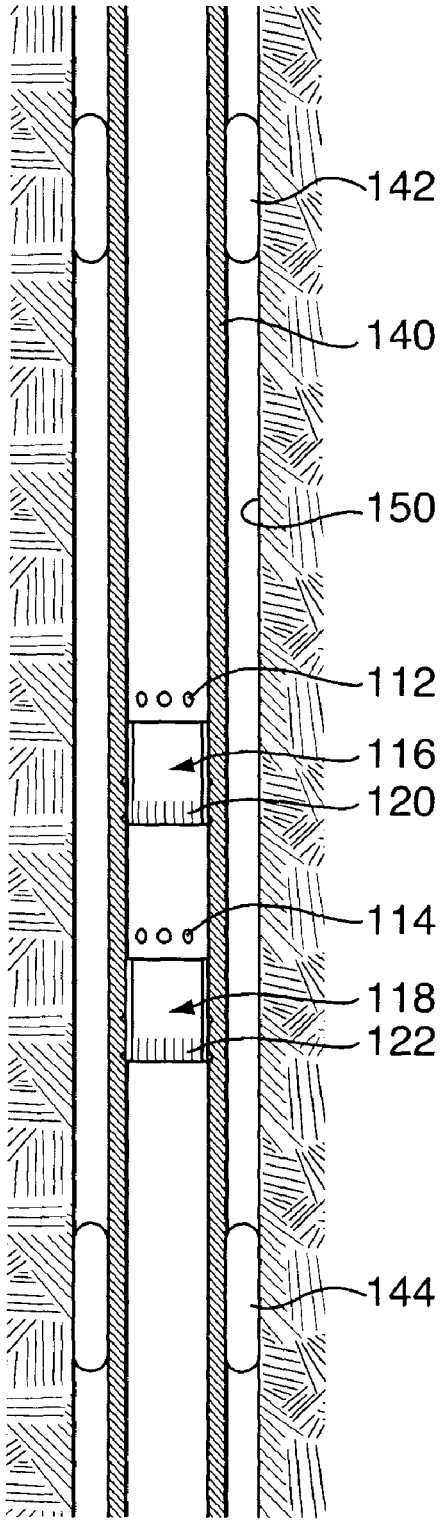
FIG. 2 is a sectional view along a portion of a well bore with a ported tubular therein.

With reference to FIG. 1, one possible embodiment of a ported sub 10 is shown. Ported sub 10 may include a tubular body including ends 10*a*, 10*b* formed for installation in a wellbore tubular string and a wall defined between an inner bore surface 10*c* and an outer surface 10*d*. The tubular body further includes at least one first port 12 through the wall and at least one second port 14 through the wall.

Ports 12 and 14 each may include a valve operable relative thereto to control opening of the port. The valve may, for example, be in the form of a sliding sleeve moveable along inner bore surface 10*c* or outer surface 10*d*. For example, a first hydraulically openable sliding sleeve 16 may be provided for controlling the open and closed condition of first port 12 and a second hydraulically openable sliding sleeve 18 may be provided for controlling the open and closed condition of the second port. Sleeves 16, 18 each include piston faces 16*a*, 18*a*, against which hydraulic pressures from within the bore of the tubular may be applied to move the sleeves. Hydraulic pressures may be generated by manipulation at surface of fluids including drilling fluid/mud, water, gases, formation fluids or various combinations thereof.

Sleeves 16, 18 may be secured in place such that they can only be moved by pressures above a certain level. For example, a first pressure release connection including one or more pressure release mechanisms, such as for example shear screws 20, may be provided for securing the first hydraulically openable sliding sleeve in a position on the tubular body. The first pressure release connection may be actuable by application of a selected hydraulic pressure to the first hydraulically openable sliding sleeve. A second pressure release connection, including one or more pressure release mechanisms, such as for example one or more shear screws 22, may be provided for securing the second hydraulically openable sliding sleeve in a position on the tubular body, the screws of such second connection being shearable by application of a hydraulic pressure substantially similar to the selected hydraulic pressure used to shear screws 20 of the first connection. In the illustrated embodiment, shear screws 20 are a different type than shear screws 22.

Although shear screws are shown, other pressure release mechanisms can be used such as, for example, other shear mechanisms such as one or more shear rings and/or one or more elastically biased mechanisms such as spring detents, collets, groove and dog interlocks, etc. To obtain the differences between the two sleeves, two altogether different mechanisms can be used such as, for example, a spring detent on one sleeve and a shear ring on the other. Alternately, similar mechanisms but with at least one difference selected from (i) material strengths (i.e. by selecting crystal form, weakened areas, etc), (ii) material of construction (i.e. polymer, brass, steel, etc.), (iii) supplier, or (iv) biasing force of a biasing mechanism.

Ends 10*a*, 10*b* may be formed in various ways for connection into a tubular string. For example, while ends 10*a*, 10*b* are shown as blanks, they may be threaded, shaped, etc. to allow threaded, welded, etc. connection, as desired.

Ports 12, 14 may be formed in various ways to allow communication between the inner bore and the outer surface of the tubular. For example, the ports may be apertures of any size and may be left open and untreated (as shown) or may include filters, diffusers, jetting devices, inserts, etc., as desired. Ports may be useful for wellbore treatment, fluid placement through the tubular, fluid circulation, fluid surges, or to access the formation for flow tests, to monitor formation pressures, etc.

Valve devices may take various forms for closing and opening the ports. For example, the sliding sleeve valves may vary from those shown such as, for example, the sleeves may be disposed to ride along the outer surface (as shown) or in the inner bore, they may be include various forms and configurations of the piston faces, they may open each by sliding in an opposite direction (as shown) or in the same axial direction. Seals such as o-rings 26 may be positioned between the sleeves and the tubular body for containing hydraulic pressure. In another embodiment, sleeves 16, 18 may be replaced with piston plates in pockets, etc.

Pressure release connections on the two sleeves are selected to be releasable each by a minimum pressure. In other words, the total pressure required to overcome the connection holding force, also called the pressure release rating, of each of the pressure release connections is selected to be released by at least a minimum suitable pressure. The intention is that at least one of the two sleeves may be opened according to at least a planned pressure profile to be generated in the tubing string. Where the tubing string can accommodate elevated pressures over the minimum pressure selected to open the ports, then the second sleeve may be openable by a hydraulic pressure above that minimum pressure, the intention being to simply ensure that at least one of the two sleeves are driveable to open the ports. In view of this, each connection includes different types of pressure release mechanisms such that although the connections are intended to release the sleeves by application of pressures that are at least a minimum, the connections have different source pressure release features, stock or different modes of operation such that at least one of the connection mechanisms should operate according to at least the planned pressure profiles.

It may be particularly useful to have the pressure release connections on the two sleeves capable of being overcome by pressures at substantially the same level, such as within +/−10% or +/−5%. In such an embodiment, it is likely that at least one of the two sleeves will open in a planned small pressure range. For example, as shown in the presently illustrated embodiment, two different types of shear screws are used on the illustrated sleeves. Sleeve 16 can be opened by overcoming the holding force of shear screws (also called pins) 20, which in this embodiment include 16 pins of the type: 1800 lb 5/16 brass shear pins, each providing a pressure holding capacity of approx 391 psi and sleeve 18 can be opened by overcoming the holding force of screws 22, which in this embodiment include 10 screws of the type: 2900 lb ⅜ 16 UNC shear pins, each providing a pressure holding capacity of approx 630 psi. In view of this, the sleeve 16 is intended to open at a selected pressure which is substantially similar to the pressure required to open sleeve 18. These sleeves being adjacently positioned on a tubing string, for example on same the tubular sub, it is likely if the tubing pressure is increased to about 6250 to 6300 psi one if not both of the sleeves will be released by overcoming the holding power of their pins 20, 22 to open the ports. It is to be understood that the foregoing specific examples are provided only for the purposes of illustration of the invention and are not provided and should not be used to limit the invention.

If even one port opens slightly, it may occur that the pressure drive capability of the tubular sub is lost. Thus, to assist with the opening of a hydraulically openable sleeve, such as sleeves 16, 18 of the presently illustrated embodiment, a biasing member may be provided to act to drive the sleeves open, when they are released. For example, a biasing member, such as springs 30, 32, may be provided to act between the tubular body and the sleeve to drive the sleeve to an open position relative to its port. In the illustrated embodiment, for example, spring 30 is compressed between piston face 16*a* and a shoulder 34 on the outer diameter of the tubular. Once the pressure release mechanism of a sleeve is overcome, for example screws 20 shear, spring 30 acts against shoulder 34 to drive the sleeve away from a position covering its port 12. Of course, the biasing force of any biasing member selected for this purpose must apply less force than that required to overcome the pressure release mechanism.

More than two sleeve/port configurations may be provided, as desired, to permit further redundancy.

A sub according to the present invention may be used in a tubular string to provide redundancy such that an operator can be relatively sure that at least one port has opened in any particular interval. For example, a tubular string 140 can include a segment carrying a first, upper packer 142 and a second, lower packer 144, such that a selected length of tubular is defined therebetween. In that selected length of tubular, redundant hydraulically openable sleeves 116, 118 may be provided that each include different pressure release mechanisms 120, 122, but that each open at a minimum selected pressure, which may be substantially the same pressure. Each sleeve controls the open and close condition of one set of ports 112, 114, such that pressuring up of the tubular string is likely to open at least one set of ports for fluid treatment of, or access to, the formation 150 between packers 142, 144.

Alternately, a tubular string may include a packer adjacent the end of the string such that a selected length of tubular is defined below the packer and the toe of the string. A tubular sub may be provided with redundant, hydraulically openable sleeves (each sleeve including different pressure release mechanisms but that each open at a minimum and possibly substantially the same selected pressure) may be provided in that selected tubular length such that pressuring up of the tubular string is likely to open at least one of the sleeves for fluid treatment of, or access to, the formation below the packer.

The tubing string may be used to gain access to an isolated region of a wellbore. The redundant sleeves increase the chances that a port can be opened to gain access to the wellbore. In order to gain access, the tubing string must be installed and the one or more packers set against the wellbore wall to isolate the wellbore below the set upper packer and either the end of the wellbore or a second packer set below the upper packer. Thereafter the tubing string may be pressured up to a pressure capable of overcoming the lowest rating pressure release mechanism for the sleeves. If the sleeve with the lowest rated pressure release mechanism is overcome and the sleeve opens, the ports under the sleeve will be exposed and access can be gained to the wellbore therethrough. If that pressure release mechanism is not overcome or the sleeve is otherwise jammed so that it doesn't open, the second sleeve is also being acted upon by the pressure such that it can at the same pressure or at a higher tubing pressure be opened by overcoming the holding force of its pressure release mechanism. Once access has been gained, wellbore treatment can be conducted by passing fluids outwardly though the opened ports. Alternately, after gaining access wellbore conditions such as formation pressures can be assessed.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A ported sub comprising: a tubular body including a wall and ends formed for installation in a wellbore tubular string; a first port through the wall; a second port through the wall; a first hydraulically openable sliding sleeve for controlling the open and closed condition of the first port; a second hydraulically openable sliding sleeve for controlling the open and closed condition of the second port; a first pressure release connection for securing the first hydraulically openable sliding sleeve in a position on the tubular body and being releasable by application of a selected hydraulic pressure to the first hydraulically openable sliding sleeve; and a second pressure release connection for securing the second hydraulically openable sliding sleeve in a position on the tubular body and being releasable by application of hydraulic pressure at least substantially similar to the selected hydraulic pressure to the first hydraulically openable sliding sleeve, the first pressure release connection including a first type of pressure release mechanism and the second pressure release connection including a second type of pressure release mechanism different than the first type of pressure release mechanism.

2. The ported sub of claim 1 wherein the first type of pressure release mechanism and the second type of pressure release mechanism differ in material of construction.

3. The ported sub of claim 1 wherein the first type of pressure release mechanism and the second type of pressure release mechanism differ in material strength.

4. The ported sub of claim 1 wherein the first type of pressure release mechanism and the second type of pressure release mechanism differ in biasing force.

5. The ported sub of claim 1 wherein the first type of pressure release mechanism is a first type of shear screw and wherein the second type of pressure release mechanism is a second type of shear screw.

6. The ported sub of claim 1 wherein the selected hydraulic pressure and the hydraulic pressure to open the second sleeve are substantially similar.

7. The ported sub of claim 1 wherein the ends are threaded to allow threaded connection into a tubing string.

8. The ported sub of claim 1 further comprising a biasing member to act to drive the first hydraulically openable sliding sleeve open when the first pressure release connection is released.

9. A wellbore fluid treatment string comprising: a tubular string including an outer surface and an inner bore; a first packer mounted on the tubular string defining a selected portion of the outer surface therebelow; a first port providing communication between the inner bore and the selected portion of the outer surface; a second port providing communication between the inner bore, the selected portion of the outer surface and the first port along the selected portion of the outer surface; a first hydraulically openable sliding sleeve for controlling the open and closed condition of the first port; a second hydraulically openable sliding sleeve for controlling the open and closed condition of the second port; a first pressure release connection for securing the first hydraulically openable sliding sleeve in a position on the tubular body and being releasable to allow the first hydraulically openable sliding sleeve to move by application of a selected hydraulic pressure to the first hydraulically openable sliding sleeve; and a second pressure release connection for securing the second hydraulically openable sliding sleeve in a position on the tubular body and being releasable to allow the second hydraulically openable sliding sleeve to move by application of a hydraulic pressure at least substantially similar to the selected hydraulic pressure to the first hydraulically openable sliding sleeve, the first pressure release connection including a first type of pressure release mechanism and the second pressure release connection including a second type of pressure release mechanism different than the first type of pressure release mechanism.

10. The wellbore fluid treatment string of claim 9 wherein the selected portion of the outer surface below the first packer extends down to an end of the tubing string without passing another packer.

11. The wellbore fluid treatment string of claim 9 wherein the selected portion of the outer surface below the first packer extends down to a second packer.

12. The wellbore fluid treatment string of claim 9 wherein the first port and the second port are carried on a single tubular sub.

13. The wellbore fluid treatment string of claim 9 wherein the first type of pressure release mechanism and the second type of pressure release mechanism differ in material of construction.

14. The wellbore fluid treatment string of claim 9 wherein the first type of pressure release mechanism and the second type of pressure release mechanism differ in material strength.

15. The wellbore fluid treatment string of claim 9 wherein the first type of pressure release mechanism and the second type of pressure release mechanism differ in biasing force.

16. The wellbore fluid treatment string of claim 9 wherein the first type of pressure release mechanism is a first type of shear screw and wherein the second type of pressure release mechanism is a second type of shear screw.

17. The wellbore fluid treatment string of claim 9 wherein the selected hydraulic pressure and the hydraulic pressure to open the second sleeve are substantially similar.

18. The wellbore fluid treatment string of claim 9 wherein the ends are threaded to allow threaded connection into a tubing string.

19. The wellbore fluid treatment string of claim 9 further comprising a biasing member to act to drive the first hydraulically openable sliding sleeve open when the first pressure release connection is released.

20. A method for gaining access to an isolated region of a wellbore, the method comprising: installing a tubular string including an outer surface and an inner bore; a first packer mounted on the tubular string defining a selected portion of the outer surface therebelow; a first port providing communication between the inner bore and the selected portion of the outer surface; a second port providing communication between the inner bore, the selected portion of the outer surface and the first port along the selected portion of the outer surface; a first hydraulically openable sliding sleeve for controlling the open and closed condition of the first port; a second hydraulically openable sliding sleeve for controlling the open and closed condition of the second port; a first pressure release connection for securing the first hydraulically openable sliding sleeve in a position on the tubular body and being releasable by application of a selected hydraulic pressure to the first hydraulically openable sliding sleeve; and a second pressure release connection for securing the second hydraulically openable sliding sleeve in a position on the tubular body and being releasable by application of a hydraulic pressure at least substantially similar to the selected hydraulic pressure to the first hydraulically openable sliding sleeve, the first pressure release connection including a first type of pressure release mechanism and the second pressure release connection including a second type of pressure release mechanism different than the first type of pressure release mechanism; setting the first packer against a wall of the wellbore to form an isolated wellbore region below the first packer; raising the tubing pressure within the tubing string to overcome at least one of the first pressure release connection and the second pressure release connection to open at least one of the first port and the second port to thereby gain access to the isolated region of the wellbore.

21. The method of claim 20 wherein gaining access to the isolated wellbore region includes treating the isolated wellbore region through the at least one opened port.

22. The method of claim 20 wherein the isolated region includes a region between the first packer and a bottom of the wellbore.

23. The method of claim 20 wherein the isolated region includes a region between the first packer and a second packer adjacent the first packer.

* * * * *